United States Patent [19]

Seyler et al.

[11] Patent Number: 4,619,328

[45] Date of Patent: Oct. 28, 1986

[54] FIRE EXTINGUISHER VALVE WITH PRESSURE INDICATOR

[75] Inventors: Gerard Seyler, Elgin; Donald R. Sloan, North Aurora, both of Ill.

[73] Assignee: Pittway Corporation, Aurora, Ill.

[21] Appl. No.: 675,630

[22] Filed: Nov. 28, 1984

[51] Int. Cl.[4] ..... A62C 23/08

[52] U.S. Cl. ..... 169/75; 116/205; 116/DIG. 17; 116/266; 222/49; 169/74

[58] Field of Search ..... 169/71, 75, 19–21, 169/30, 74, 89; 37/553, 558, 557; 222/23, 394, 49; 116/266, 205, DIG. 17, 277

[56] References Cited

U.S. PATENT DOCUMENTS

| | | |
|---|---|---|
| 2,548,750 | 4/1951 | Stroop . |
| 2,748,744 | 6/1956 | Trulove . |
| 2,753,945 | 7/1956 | Beebee et al. . |
| 2,851,985 | 9/1958 | Keehn . |
| 3,105,458 | 10/1963 | Downham . |
| 3,209,949 | 10/1965 | Gurtler . |
| 3,229,851 | 1/1966 | Horwitt et al. . |
| 3,643,691 | 2/1972 | Huthsing, Jr. . |
| 3,675,722 | 7/1972 | Balmes, Sr. . |
| 3,703,879 | 11/1972 | Huthsing, Jr. . |
| 3,738,311 | 6/1973 | Appleton . |

FOREIGN PATENT DOCUMENTS

| | | | |
|---|---|---|---|
| 1434905 | 11/1968 | Fed. Rep. of Germany | 169/32 |
| 1302111 | 7/1962 | France | 169/75 |

*Primary Examiner*—Jeffrey V. Nase
*Assistant Examiner*—L. E. Williams
*Attorney, Agent, or Firm*—Emrich & Dithmar

[57] ABSTRACT

A discharge valve assembly for a fire extinguisher container includes a housing defining a passageway providing communication between the container outlet and a nozzle. An elongated tubular valve stem is axially movable in the passageway between open and closed conditions with respect to a valve seat in the passageway, the stem projecting from the passageway for engagement by an actuating lever. An elongated indicating rod, shorter than the valve stem, is coaxially movable therein between extended and retracted conditions. A bias spring and the pressure in the container holds the valve stem closed, and the pressure in the container holds the indicating rod extended. A bias spring urges the indicating rod toward a retracted position. To check the pressure the indicating rod is manually depressed, the extent to which it returns to its extended condition being indicative of the magnitude of the pressure in the container. The bias springs for the indicating rod and the valve stem are disposed within the passageway. No seals are necessary above the valve seat between the valve stem and the passageway and the indicating rod.

20 Claims, 3 Drawing Figures

FIRE EXTINGUISHER VALVE WITH PRESSURE INDICATOR

BACKGROUND OF THE INVENTION

The present invention relates to valve mechanisms for controlling the discharge of material under pressure from a container. In particular, the invention relates to discharge valves for fire extinguishers.

There are present in the prior art many container closures and dispensing devices designed to operate with fluids or free-flowing powders which are under pressure, such as fire extinguishers. Such dispensing devices have also been provided with pressure indicating means to give an indication of the pressure within the container so that a user can tell whether the container needs to be repressurized or refilled. However, such prior dispensing devices with pressure indicators are typically of complex construction, comprising a large number of parts. In many cases some of these parts or portions thereof are exposed in use, so as to be subject to the environment in which the fire extinguisher is used or stored. Furthermore, in those devices in which the indicating means forms a part of the valve mechanism, it typically entails elongation of the valve mechanism and, therefore, the housing thereof, thereby increasing the overall size of the extinguisher.

SUMMARY OF THE INVENTION

It is a general object of this invention to provide a dispensing apparatus which avoids the disadvantages of prior devices while affording additional structural and operating advantages.

An important object of the invention is the provision of a dispensing apparatus with pressure indicating means which is of relatively simple and economical construction.

Another object of the invention is the provision of a dispensing apparatus of the type set forth, wherein, all parts which do not have to be touched by the user are protected within a housing.

Yet another object of the invention is the provision of a dispensing apparatus of the type set forth which is of compact construction.

In connection with the foregoing objects, it is another object of the invention to provide a combination of a pressurized container with the dispensing apparatus of the type set forth.

These and other objects of the invention are attained by providing in a dispensing apparatus for controlling the discharge of material under pressure from a container outlet, including a nozzle and a passageway providing communication between the container outlet and the nozzle, and a valve seat in the passageway, the improvement comprising: an elongated tubular valve stem disposed in the passageway and having an actuating end projecting from the passageway, seal means carried by said valve stem, the valve stem being movable axially of the passageway, bias means resiliently urging the valve stem to a closed condition wherein the seal means is disposed in sealing engagement with the valve seat, the valve stem being responsive to an external force on the actuating end thereof for movement to an open condition wherein the valve stem and the seal means are spaced from the valve seat, and elongated indicating means shorter than the valve stem and disposed therewithin for movement axially with respect thereto, the indicating means having an inner end disposed at all times within the valve stem and an outer end, the indicating means being responsive to pressure in the container for movement to extended positions with the outer end extending from the actuating end of the valve stem a distance which varies with the pressure.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
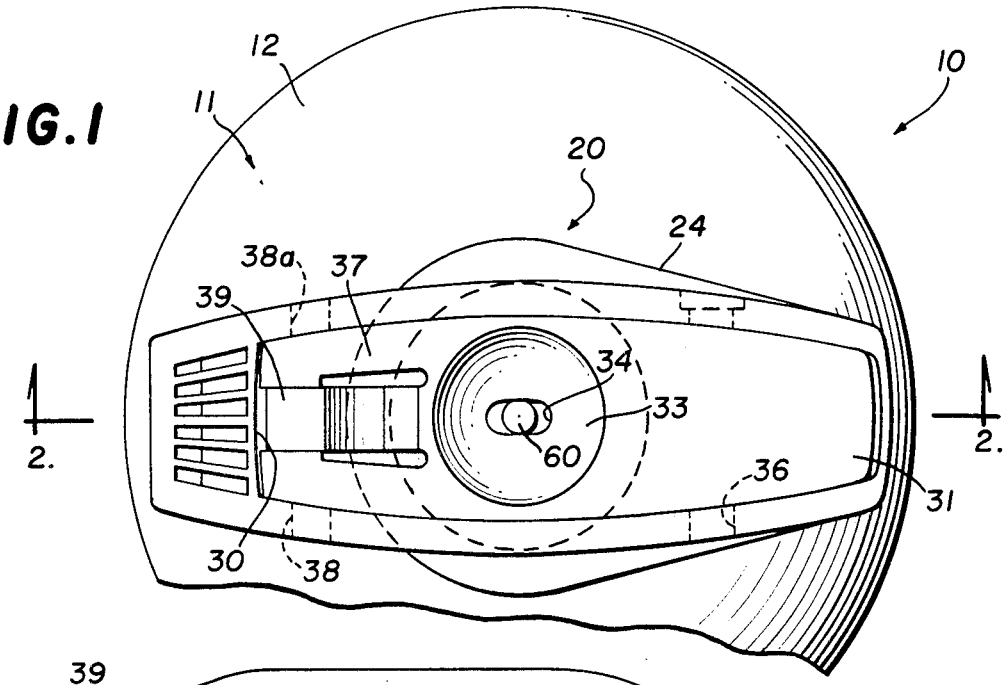
FIG. 1 is a fragmentary top plan view of a fire extinguisher incorporating a dispensing apparatus constructed in accordance with and embodying the features of the present invention.

There is illustrated in the drawings a fire extinguisher, generally designated by the numeral 10, including a container 11 for holding fire extinguishing material under pressure. Preferably, the fire extinguishing material is a dry chemical extinguisher comprising a dry powder and a pressurized impelling gas for expelling the powder from the container. However, it will be appreciated that the present invention could be used with other types of fire extinguishing materials.

The container 11 includes a bottle-shaped shell 12 having an internally threaded neck 13 at one end thereof coaxial therewith defining a circular outlet opening. Disposed in the shell 12 coaxially therewith is an elongated siphon tube 14, the upper end of which is received in a cylindrical adapter 15. More particularly, the adapter 15 has a cylindrical bore 16 extending axially therethrough, having at its inner end a counterbore portion defining an annular shoulder 17 against which the distal end of the siphon tube 14 is seated. Integral with the adapter 15 at its inner end and extending radially outwardly therefrom is an annular flange 18. Integral with the outer end of the adapter 15 is a cylindrical lip 19 disposed in surrounding relationship with the outer end of the bore 16. Preferably, the upper end of the siphon tube 14 is press-fitted into the adapter 15.

The adapter 15 is carried by a dispenser assembly 20 which includes an elongated housing 21 having an externally threaded cylindrical attachment portion 22 at one end thereof disposed for threaded engagement in the neck 13 of the container 11. The housing 21 carries a flange **22*a*** engageable with the distal end of the neck 13 to limit the depth of insertion of the attachment portion 22 therein, a resilient seal ring 23 being disposed between the neck 13 and the flange 22*a* for providing a fluid-tight seal therebetween. A handle 24 projects laterally from the side of the housing 21.

Extending longitudinally through the housing 21 and the attachment portion 22 thereof is a generally cylindrical bore or passageway 25. The adapter 15 is dimensioned to be received in the inner end of the passageway 25, with the flange 18 abutting against the inner end of the attachment portion 22 and secured thereto by suitable means. The inner surface of the passageway 25 has a frustoconical portion intermediate the ends thereof defining a valve seat 26. The portion 27 of the passageway 25 disposed outwardly beyond the valve seat 26 has walls which coverage toward the outer end of the passageway 25 where it exits the outer end of the housing 21. The housing 21 includes a nozzle portion 28 which is integral therewith and projects laterally therefrom adjacent to the outer end thereof, and which has a nozzle bore 29 therethrough which communicates with the outer portion 27 of the passageway 25.

Figure 2:
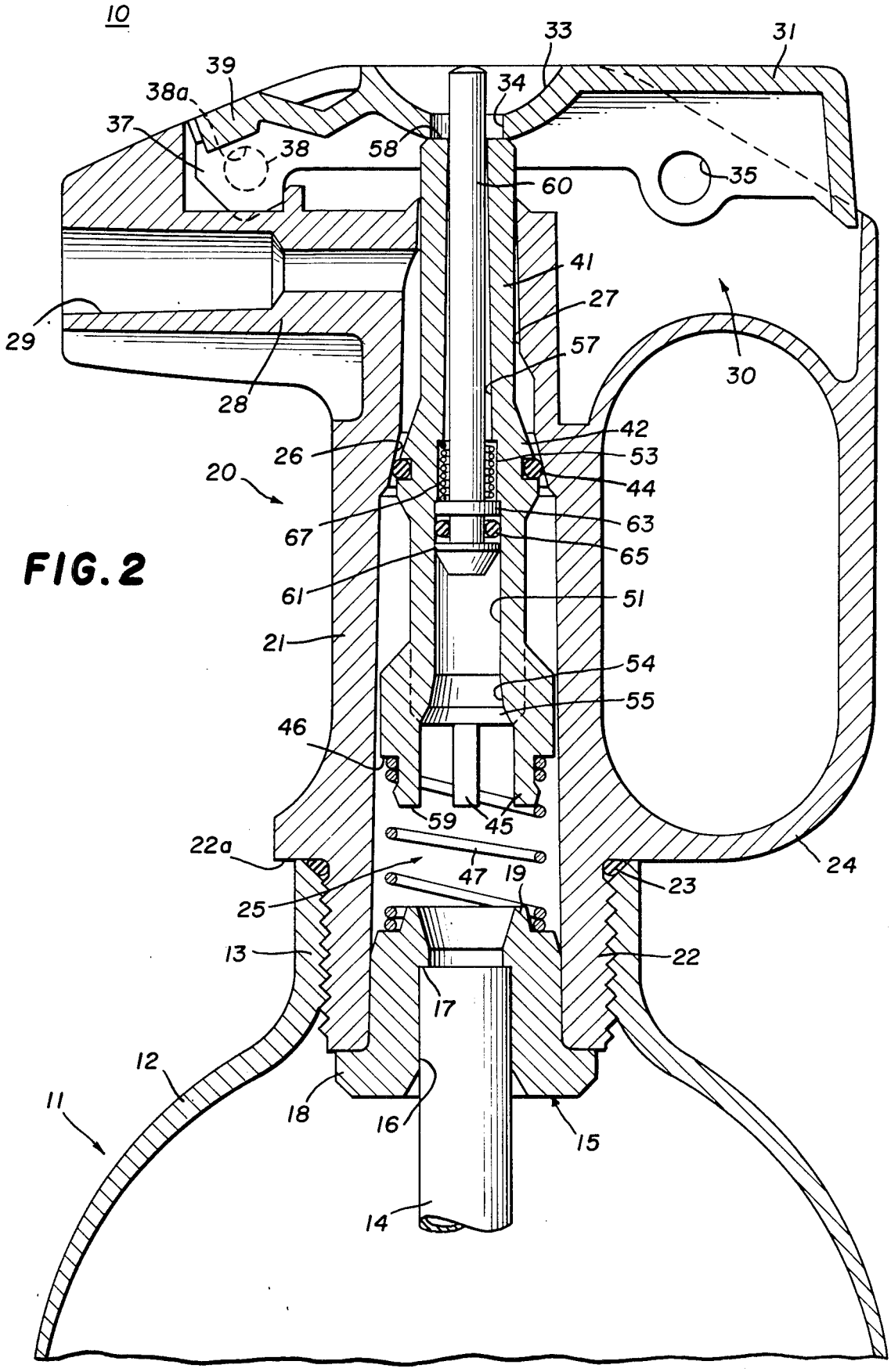
FIG. 2 is an enlarged, fragmentary view in vertical section taken along the line 2—2 in FIG. 1, illustrating the valve assembly of the dispensing apparatus in its normal closed condition.

The outer end of the passageway 25 communicates with an irregular lever recess 30 formed in the outer end of the housing 21. Disposed in the recess 30 is an actuating lever 31, which has one end thereof pivotally connected to the housing 21 in a manner described below for pivotal movement between a normal rest position, illustrated in FIG. 2, and an actuating position, illustrated in FIG. 3. The actuating lever 31 is provided with a concave, part-spherical portion 33 intermediate its ends, overlying the outer end of the passageway 25, and having an elongated aperture 34 therein. Also formed through the actuating lever 31 adjacent to the distal end thereof is a hole 35 which is adapted for coaxial alignment with like holes 36 in the housing 21 for receiving a safety pin (not shown), for holding the actuating lever 31 in its normal rest position and preventing movement thereof to the actuating position.

The pivoted end of the actuating lever 31 is bifurcated, defining a pair of elongated, laterally flexible and resilient arms 37. Each of the arms 37 is provided adjacent to its distal end with a laterally outwardly extending pivot lug 38, the lugs 38 being disposed to be respectively received in complementary bores 38*a* in the side walls of the lever recess 30 for pivotal mounting of the actuating lever 31. The actuating lever 31 is also provided with an elongated, flexible retaining member 39 which extends between the arms 37 generally parallel thereto and having a lateral width so as substantially to occupy the space between the arms 37. In mounting the actuating lever 31 in place on the housing 21, the retaining member 39 is deflected downwardly or upwardly from between the arms 37 and the arms 37 are squeezed together to permit the pivot lugs 38 to be aligned with the bores 38*a*. The arms 37 are then released to seat the lugs 38 in the bores 38*a* and the retaining member 39 is then released to return to its rest position between the arms 37. The retaining member 39 will prevent the arms 37 from being accidentally moved back together, thereby to prevent accidental dislodgement of the actuating lever 31, such as in the event that the container 11 is dropped.

Disposed within the housing 21 is a valve assembly 40, which includes an elongated tubular valve stem 41 disposed coaxially within the passageway 25 for movement axially with respect thereto. The outer surface of the valve stem 41 has a frustoconical seal portion 42 intermediate its ends. Formed in the seal portion 42 is a circumferential groove 43 which receives therein a resilient O-ring seal 44 disposed for fluid-tight sealing engagement with the valve seat 26 when the valve stem 41 is disposed in a closed condition, illustrated in FIG. 2. In this closed condition the outer end of the valve stem 41 projects a predetermined distance outwardly beyond the outer end of the passageway 25 for engagement with the concave portion 33 of the actuating lever 31 in the rest position thereof. The inner end of the valve stem 41 is provided with four equiangularly spaced-apart, radially outwardly extending fins 45, each of which is provided with a groove 46 adjacent to its inner end. Seated in the grooves 46 is one end of a helical compression spring 47, the other end of which is seated against the outer end of the adapter 15 in surrounding relationship with the cylindrical lip 19, for resiliently urging the valve stem 41 toward its closed condition.

Extending axially through the valve stem 41 is a bore 50 having a central cylindrical portion 51 which is joined by an annular shoulder 52 to a reduced-diameter cylindrical portion 53. The inner end of the cylindrical portion 51 joins a frustoconical portion 54, which in turn joins a frustoconical entry portion 55 at the inner end of the valve stem 41. The outer end of the reduced-diameter cylindrical portion 53 is joined by an annular shoulder 56 to an elongated tapered portion 57, which is generally frustoconical and converges toward the outer end of the valve stem 41, exiting the valve stem 41 at a concave end face 58 which is shaped substantially complementary to the concave portion 33 of the actuating lever 31. The fins 45 on the valve stem 41 minimize the radial movement of the valve stem 41 relative to the passageway 25.

Disposed coaxially within the bore 50 is an elongated cylindrical indicator rod 60, having a length less than that of the valve stem 41. The indicator rod 60 has an enlarged-diameter inner end 61 disposed for sliding engagement with the wall of the cylindrical portion 51 of the bore 50, the enlarged end 61 having a frustoconical outer surface 62. Also integral with the indicator rod 60 and extending radially outwardly therefrom a slight distance from the enlarged end 61 is an annular flange 63. The flange 63 has an outer diameter substantially equal to that of the enlarged end 61 and cooperates therewith to define therebetween an annular groove 64, in which is received a resilient O-ring seal 65 for fluid-tight sealing engagement with the cylindrical portion 51 of the bore 50. Disposed in surrounding relationship with the indicator rod 60 and trapped between the flange 63 and the shoulder 56 in the reduced-diameter portion 53 of the bore 50 is a helical compression spring 67, which resiliently urges the indicator rod 60 toward a retracted position, illustrated in broken line in FIG. 3.

The flange 63 is engageable with the shoulder 52 for limiting the axial outward movement of the indicator rod 60 in its fully extended position, illustrated in solid line in the drawings, wherein the outer end of the indicator rod 60 projects a predetermined distance outwardly beyond the end face 58 of the valve stem 41. The parts are arranged so that the projecting portion of the indicator rod 60 extends outwardly through the slot 34 in the actuating lever 31 for access by a user, as will be explained more fully below.

In operation, the passageway 25 communicates with the siphon tube 14 and is, therefore, exposed to the internal pressure within the container 11. This pressure acts on the valve stem 41 and, particularly, the seal portion 42 thereof, below the O-ring 44, as well as on the 0-ring 44, for urging the valve stem 41 outwardly and holding it in its closed condition, illustrated in FIG. 2. It will be appreciated that in this closed condition the flow of extinguishing material to the nozzle bore 29 is blocked by the fluid-tight seal formed by the O-ring seal 44 between the seal portion 42 and the valve seat 26. The fluid-tight seal formed by the O-ring seal 65 between the indicator rod 60 and the valve stem 41 prevents the flow of extinguishing material between the indicator rod 60 and the valve stem 41. This pressure also holds the indicator rod 60 in its extended position.

Figure 3:
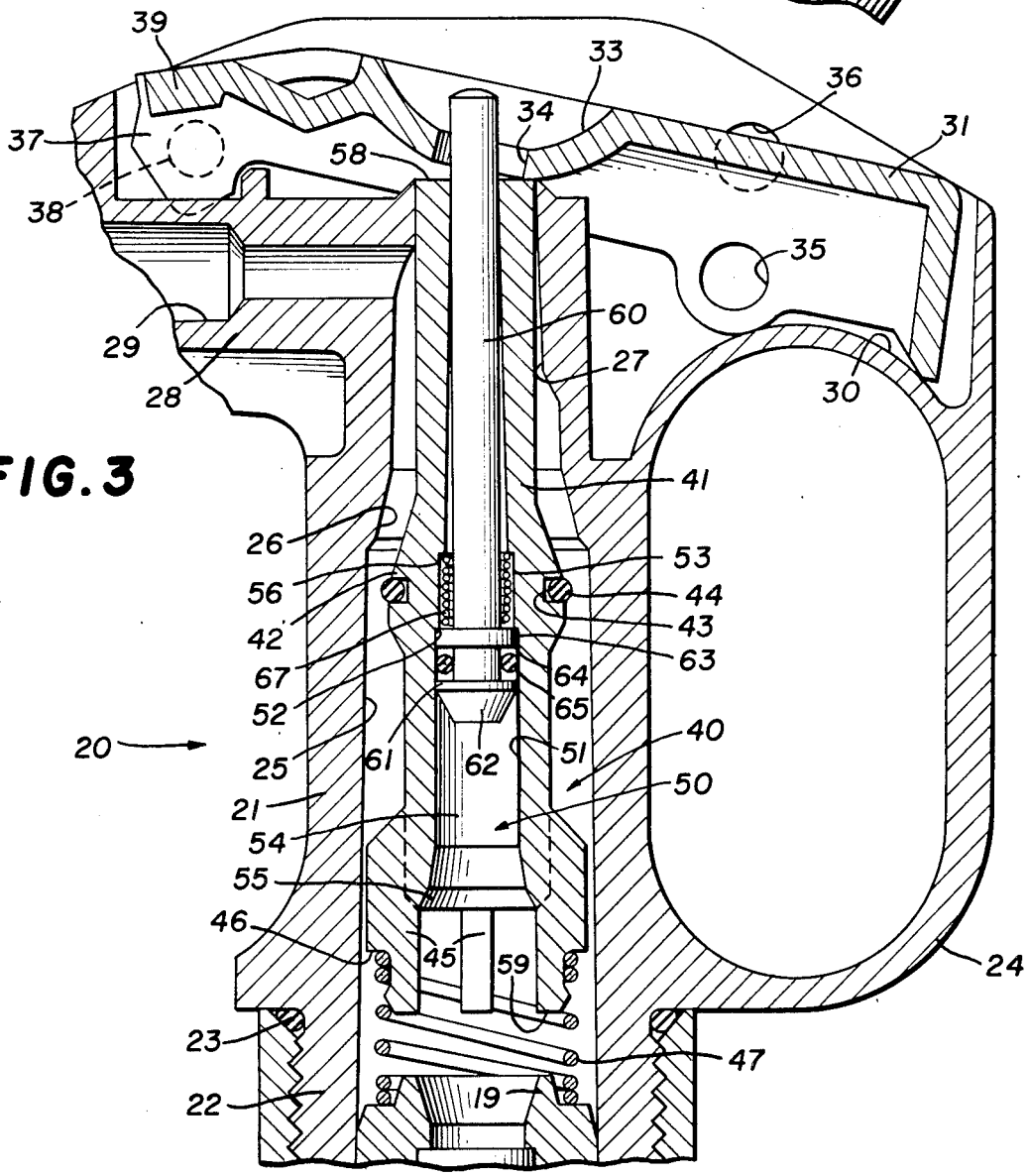
FIG. 3 is a fragmentary view similar to FIG. 2, illustrating the valve assembly in its open condition and illustrating operation of the pressure indicating means.

When it is desired to use the fire extinguisher 10, the safety pin is pulled and the actuating lever 31 is manually depressed to the actuating position, illustrated in FIG. 3, for driving the valve stem 41 inwardly to its open condition, illustrated in FIG. 3, wherein the seal portion 42 thereof is spaced from the valve seat 26 to permit the flow of extinguishing material from the siphon tube 14, around the valve stem 41 and outwardly through the nozzle bore 29. The position of the indicator rod 60 relative to the valve stem 41 does not change during this movement of the valve stem 41 to its open condition. After the extinguishing is completed, the actuating lever 31 is released and the valve stem 41 is returned to its closed position, either under the action of the pressure within the container 11 or, if the remaining pressure is insufficient, under the action of the spring 47.

It is a significant aspect of the present invention that the indicator rod 60 permits the user to test the pressure in the container 11. For this purpose, the indicator rod 60 is manually depressed by the user's thumb to a retracted or withdrawn position, illustrated in broken line in FIG. 3, against the urging of the pressure in the container 11. If the pressure within the container 11 is adequate for use, it will return the indicator rod 60 to its fully extended position. If the pressure is inadequate, it will not be sufficient to overcome the force of the bias spring 67 and, accordingly, the indicator rod 60 will remain in its depressed or withdrawn position or will not fully return to its extended position.

It is a further significant aspect of the invention that the valve stem 41 and the indicator rod 60 are each of unitary, one-piece construction, thereby serving to minimize the number of parts in the dispenser assembly 20 and to simplify fabrication. The diameter of the indicator rod 60 may be such that it is disposed in sliding engagement around the entire circumference thereof with the valve stem 41 at the outer end of the tapered portion 57 of the bore 50. The outer diameter of the valve stem 41 is such that it is disposed in sliding engagement around the entire circumference thereof with the housing 21 at the outer end of the passageway 25. This engagement provides a partial seal which is sufficient to prevent the escape of extinguishing material from the outer end of the passageway 25 when the fire extinguisher 10 is in use, thereby obviating the use of a separate seal member at this location.

It will be appreciated that the inner end of the indicator rod 60 is at all times disposed well within the bore 50. Thus, the indicator rod 60 does not necessitate any extension of the length of the valve stem 41 or the dispenser assembly 20. Furthermore, it will be noted that the bias springs 47 and 67 and the seal members 44 and 65 are all disposed within the passageway 25 between the adapter 15 and the nozzle portion 28, none of these parts being exposed in use.

In a constructional model of the present invention, the bias springs 47 and 67 are preferably made of stainless steel, the O-ring seals 44 and 65 and made of any suitable material approved by Underwriters Laboratories for use with dry chemical extinguishers; the siphon tube 14 may be formed of a rigid polypropylene material; the housing 21 and the actuating lever 31 may be formed of nylon; and the adapter 15, the valve stem 41 and the indicator rod 60 may be formed of an acetal copolymer, such as that sold by Celanese Plastics & Specialties Co. under the trademark "CELCON".

From the foregoing, it can be seen that there has been provided an improved dispenser assembly for a pressurized container, which also affords a pressure indication, the assembly being characterized by a simple and economical construction and a minimal number of parts, most of which are completely protected and non-exposed in use, the assembly being of compact construction.

We claim:

1. In a dispensing apparatus for controlling the discharge of material under pressure from a container outlet, including a nozzle and a passageway providing communication between the container outlet and the nozzle, and a valve seat in the passageway, the improvement comprising: an elongated tubular valve stem disposed in the passageway and having an actuating end projecting from the passageway, seal means carried by said valve stem, said valve stem being movable axially of the passageway, bias means disposed in the passageway between the container outlet and the valve seat for resiliently urging said valve stem to a closed condition wherein said seal means is disposed in sealing engagement with the valve seat, said valve stem being responsive to an external force on said actuating end thereof for movement to an open condition wherein said valve stem and said seal means are spaced from said valve seat, said valve stem having an enlarged-diameter cavity portion therein exposed to the material under pressure, and elongated indicating means shorter than said valve stem and disposed therewithin for movement axially with respect thereto, said indicating means having an enlarged inner end disposed at all times within said cavity portion of said valve stem and an outer end, said indicating means being responsive to pressure in the container for movement to extended positions with said outer end extending from said actuating end of said valve stem a distance which varies with the pressure.

2. The dispensing apparatus of claim 1, wherein said seal means is disposed intermediate the ends of said valve stem.

3. The dispensing apparatus of claim 1, and further including manually operable actuating means disposed for engagement with said actuating end of said valve stem for effecting movement thereof to the open condition thereof.

4. The dispensing apparatus of claim 1, wherein said outer end of said indicating means is disposed for access by a user for manual movement thereof from the extended position thereof against said pressure for testing the magnitude of the pressure.

5. The dispensing apparatus of claim 4, and further including second bias means resiliently urging said indicating means toward the retracted position thereof.

6. In a dispensing apparatus for controlling the discharge of material under pressure from a container outlet, the combination comprising: a housing defining an elongated passageway having one end thereof communicating with the container outlet and being open at the other end thereof, said passageway having an inner surface with a portion converging toward said open end thereof, a nozzle communicating with said passageway, a valve seat formed in said passageway between the container outlet and said nozzle, an elongated tubular valve stem disposed in said passageway and having an actuating end projecting from said open end of said passageway, said valve stem being axially movable in said passageway, seal means carried by said valve stem intermediate the ends thereof, said valve stem having an inner surface with a portion converging toward said actuating end thereof and with an enlarged-diameter cavity portion therein exposed to the material under pressure, bias means disposed in said passageway between the container outlet and said valve seat for resiliently urging said valve stem to a closed condition wherein said seal means is disposed in sealing engagement with said valve seat, said valve stem being responsive to an external force on said actuating end thereof for movement to an open condition wherein said valve stem and said seal means are spaced from said valve seat, said valve stem being slidably engageable with said converging portion of said inner surface of said passageway at said open end thereof, and elongated indicating means shorter than said valve stem and disposed therewithin for movement axially with respect thereto, said indicating means having an enlarged inner and disposed at all times within said cavity portion of said valve stem and an outer end disposed for sliding engagement with said converging portion of the inner surface of said valve stem at said actuating end thereof, said indicating means being responsive to pressure in the container for movement to extended positions with said outer end extending from said actuating end of said valve stem a distance which varies with the pressure.

7. The dispensing apparatus of claim 6, wherein said valve stem is of unitary one-piece construction.

8. The dispensing apparatus of claim 6, wherein said indicating means comprises an elongated indicating member of unitary one-piece construction.

9. The dispensing apparatus of claim 8, and further including a resilient seal member carried by said indicating member and disposed in sealing relationship with said valve stem.

10. The dispensing apparatus of claim 6, and further including second bias means resiliently urging said indicating means to a retracted condition, both of said bias means being disposed entirely within said passageway between said nozzle and the container outlet.

11. The dispensing apparatus of claim 6, and further including manually operable actuating means pivotally mounted on said housing for engagement with said actuating end of said valve stem to effect movement thereof to the open condition thereof.

12. The dispensing apparatus of claim 11, wherein said housing has a pair of spaced-apart coaxial pivot bores, said actuating means including a pair of spaced-apart resilient arms and two pivot lugs respectively carried by said pivot arms, said pivot arms being deflectable toward each other to permit seating of said pivot lugs in said pivot bores, and a flexible retaining member normally disposed between said arms and deflectable from therebetween to accommodate deflection of said arm toward each other.

13. In combination, a container for material under pressure and having an outlet, a discharge housing adapted to be coupled to said container and defining a passageway having one end communicating with said outlet and being open at the other end thereof, a nozzle communicating with said passageway, a valve seat formed in said passageway between said nozzle and said container outlet, an elongated tubular valve stem disposed in said passageway and having an actuating end projecting from said passageway, seal means carried by said valve stem, said valve stem being movable axially of said passageway, bias means disposed in said passageway between said container outlet and said valve seat for resiliently urging said valve stem to a closed condition wherein said seal means is disposed in sealing engagement with said valve seat, said valve stem being responsive to an external force on said actuating end thereof for movement to an open condition wherein said valve stem and said seal means are spaced from said valve seat, said valve stem having an enlarged-diameter cavity portion therein exposed to the material under pressure, and elongated indicating means shorter than said valve stem and disposed therewithin for movement axially with respect thereto, said indicating means having an enlarged inner end disposed at all times within said cavity portion of said valve stem and an outer end, said indicating means being responsive to pressure in the container for movement to extended positions with said outer end extending from said actuating end of said valve stem a distance which varies with the pressure.

14. The combination of claim 13, wherein said passageway is disposed coaxially with said container outlet.

15. The combination of claim 13, and further including second bias means resiliently urging said indicating means to a retracted condition, both of said first and second bias means being disposed entirely within said passageway between said nozzle and said container outlet.

16. The combination of claim 13, wherein said valve stem is of unitary one-piece construction.

17. The combination of claim 16, wherein said indicating means comprises an elongated indicating member of unitary one-piece construction.

18. The combination of claim 13, wherein said outer end of said indicating means is disposed for access by a user for manual movement thereof from the extended position thereof against said pressure for testing the magnitude of the pressure.

19. The combination of claim 13, and further including manually operable actuating means pivotally mounted on said housing for engagement with said actuating end of said valve stem to effect movement thereof to the open condition thereof.

20. The combination of claim 19, wherein said housing has a pair of spaced-apart coaxial pivot bores, said actuating means including a pair of spaced-apart resilient arms and two pivot lugs respectively carried by said pivot arms, said pivot arms being deflectable toward each other to permit seating of said pivot lugs in said pivot bores, and a flexible retaining member normally disposed between said arms and deflectable from therebetween to accommodate deflection of said arms toward each other.

* * * * *

UNITED STATES PATENT AND TRADEMARK OFFICE

CERTIFICATE OF CORRECTION

PATENT NO. : 4,619,328

DATED : October 28, 1986

INVENTOR(S) : Gerard Seyler and Donald R. Sloan

It is certified that error appears in the above—identified patent and that said Letters Patent is hereby corrected as shown below:

On the title page,

[56] References Cited

Please add --3,747,557 7/73 Bayly et al.
3,814,298 6/74 Hansen--.

Column 7, line 28, "and" should be --end--;

line 65, "arm" should be --arms--.

Signed and Sealed this

Twentieth Day of January, 1987

*Attest:*

DONALD J. QUIGG

*Attesting Officer*

*Commissioner of Patents and Trademarks*